United States Patent [19]

Paddock

[11] Patent Number: 5,069,007

[45] Date of Patent: Dec. 3, 1991

[54] WHEEL CHANNEL GUIDE-LOCK FOR GYMNASIUM BLEACHERS

[75] Inventor: Eugene T. Paddock, Downers Grove, Ill.

[73] Assignee: E. T. Paddock Enterprises, Inc., Lemont, Ill.

[21] Appl. No.: 622,847

[22] Filed: Dec. 6, 1990

[51] Int. Cl.[5] ..... E04H 3/12

[52] U.S. Cl. ..... 52/9; 52/126.1

[58] Field of Search ..... 52/8, 9, 126.1

[56] References Cited

U.S. PATENT DOCUMENTS

| | | | |
|---|---|---|---|
| 2,870,492 | 1/1959 | Chervenka | 52/9 |
| 3,069,732 | 12/1962 | Murphy | 52/10 |
| 3,069,733 | 12/1962 | Murphy | 52/10 |
| 3,157,916 | 11/1964 | Puestow | 52/8 |
| 3,222,827 | 12/1965 | Smith | 52/9 |
| 3,335,533 | 8/1967 | Bahr | 52/126.1 |
| 3,389,511 | 6/1968 | Drehobl | 52/9 |
| 3,425,173 | 2/1969 | Carlo | 52/8 |
| 3,478,473 | 11/1969 | Hoven | 52/9 |
| 3,608,251 | 9/1971 | Scaggs | 52/9 |
| 4,285,172 | 8/1981 | Quigley | 52/10 |

*Primary Examiner*—James L. Ridgill, Jr.
*Attorney, Agent, or Firm*—Lee, Mann, Smith, McWilliams & Sweeney

[57] ABSTRACT

A wheel channel guide-lock assembly for laterally, vertically and horizontally securing adjacent telescoping wheel channels of a bleacher system. The assembly comprises a first type of bracket attached in pairs on one wheel channel which include axles extending therefrom for replacing existing channel wheel axles at opposite ends of a wheel channel. A second type bracket slidingly engages along a rod extending between the said first type brackets of the channel and is attached to an adjacent wheel channel whereby sequentially, adjacent channels are guided and locked together by means of the first brackets preventing the second bracket from sliding therepast.

14 Claims, 3 Drawing Sheets

A
16
16
31
B
A
A
16
19
32
A
33
31
32
B
A
A
31
L
16
B
16
19
A
16
19
A
16
16
31
B
A
A
16
19
32
A
31
33
32
A
B
31
A
R
16
B
19
16
A
16
19

WHEEL CHANNEL GUIDE-LOCK FOR GYMNASIUM BLEACHERS

BACKGROUND OF THE INVENTION

The invention is in general directed toward providing a safety lock feature for gymnasium bleachers. More specifically, the invention is directed to providing a wheel channel guide-lock assembly at the lower wheel channels of bleacher rows to prevent lateral, vertical or horizontal displacement. Even more particularly, the invention is directed toward providing a retrofit guide lock assembly for existing manual or power operated telescoping bleachers at each bleacher row.

The invention was made in the course of seeking to solve problems with in-place bleacher collapses of defectively installed or maintained prior art manually or power operated telescoping bleachers. The need for the invention was prompted by a rash of injuries from bleacher collapses, perhaps caused by improper maintenance or incorrect operation of numerous installed bleachers, particularly those school gymnasium bleacher systems installed approximately ten to fifteen years before this invention. The United States Consumer Product Safety Commission, through its Office of Information and Public Affairs, has promulgated a warning with regard to the problems with these types of bleachers. The Commission advised that such telescoping bleachers should be inspected for damage, wear and misalignment and that they should be inspected and maintained in accordance with the manufacturers' operating manuals provided to the purchaser.

Usually, manual or power operated telescoping bleacher assemblies include row locks that trip upward automatically and hold each bleacher row in place until returned to the stacked position. The row locks operate by gravity when the bleachers are extended and typically seat into horizontal wheel channel tabs to lock the particular bleacher row in place and keep the bleacher row secure while spectators sit on the bleacher seats. When the row locks become bent, disconnected, or otherwise not engaged properly, bleacher safety is compromised in misalignment. Binding of the bleachers can occur while the bleacher section is being operated. Effective row locks should be repaired and replaced as these occurrences are detected. But in the past, such has not been the case and it became important that a solution to the resulting bleacher defects be found by means of a retrofit assembly that is useful for various manufacturers' bleacher systems of the telescoping wheel-channel type.

It is noteworthy that manufacturers have instructed the purchasers of bleacher systems to use two people to manually extend the bleachers in order to prevent racking, which is an uneven extension of the bleacher rows and supports. If bleachers become racked, they can lead to serious damage to understructure support channels, braces, and connections. Also, adjoining ends of wheel channels for each row of bleachers are typically provided with finger locks on each channel for engagement to prevent collapse. If they become broken or missing, the adjoining rows will misalign and harmfully bend or possibly crack weld and gusset connections. Usually welds between channels and supporting columns for the rows are provided at gussetted joints therebetween. Welds may also crack should racking or misalignment occur, which causes the channel guides to bind against one another or be displaced away from each other and from the intended telescoping paths of travel. The greatest danger is caused when the locking fingers fail to properly engage whereby the front end, or toe, of a wheel channel guide tips upward. Then, the upper end of the attached column is caused to rotate out of alignment and damage connections to the joint weld at the upper connection to the seat assembly above.

These and other modes of failure are known in the industry and have been serious concerns, due to the number of accidents and injuries to spectators that have occurred and may potentially occur.

As a result, it is a primary goal of the invention to provide a wheel channel guide-lock assembly usable at the wheel channels of telescoping bleacher systems to retain the wheel channels and prevent lateral, vertical and horizontal displacement.

It is a further goal of the invention to provide for such an assembly that may be retrofitted into previously installed systems, such as those sold under the brand names Brunswick, Vecta or Interkal, which comprise bleacher systems primarily installed about ten to fifteen years ago across the United States.

It is a further goal of the invention to provide a wheel channel guide-lock assembly that accommodates uneven floor conditions to securely retain the wheel channels and prevent collapse.

It is an allied goal of the invention to provide a wheel channel guide-lock assembly that may be used in a variety of telescoping bleacher systems, wherein sequential rows of bleachers have wheel channel guides providing rolling support along the floor and which telescope, and slidingly move past each other, from a stacked position to an extended position for use.

It is also an object of the invention to provide a wheel channel guide lock assembly that may be used for originally manufactured telescoping bleacher systems in order to provide a safe and secure means to prevent bleacher collapse and minimize structural damage from racking, shifting or excessive torsion at structural member joint connectors and the like.

SUMMARY OF THE INVENTION

The invention may be summarized as providing for the alternate attachments of two types of brackets welded to sides of wheel channels for telescoping bleachers. The brackets comprise an A bracket and a B bracket wherein a slide rod is movably extensible through guide sleeves on the B brackets and is provided with stop means at both ends, so as not to slip from the sleeves of the A brackets at opposite ends. The brackets also have replacement axles for engagement with existing wheels that are located within wheel channels in order to create a secure retention of the wheels themselves to prevent unwanted racking or binding.

The two types of brackets are manually engageable to the wheel channel guides at wheel axle locations to coaxially align the bracket sleeves at adjacent sides of the wheel channels for the positioning of the slide rods.

The replacement axles of the brackets A and B extend across the channel for the rotational support of the existing wheels whose axles have been removed. Lock nuts, mechanical friction snap-on caps, or the like, secure the axle and thereby the bracket at the channel side opposite the sleeve side.

The wheel channel of the bottommost row of bleachers is provided with a single bracket of the B type having a flat longer flange portion than the A brackets. The wheel channel for the uppermost row of bleachers is provided with two brackets of the A type at both ends thereof. Typically, wheel channels are provided with a plurality of wheels at the rear ends and single wheels at the front ends. The invention provides for the attachment of brackets at any of the rear wheels, but preferably envisions the attachment of an A bracket at the rearmost wheel. Channels between the front and rear channels, are fitted with two A type brackets having sleeves positioned at interior lateral sides of the channel and one B type bracket providing a sleeve at the opposite channel side for sliding disposition along the slide rod between two A brackets of the next sequential channel. Upon restacking the bleachers after a sporting event, for example, the channels are urged backward, usually by two people, or by power operation whereby the sleeves of the B type brackets move along the slide rods to abut the rearmost A brackets of the next sequential channels and are pushed thereagainst to sequentially restack the bleachers. Accordingly, the B type brackets slide along inbetween the A brackets of adjacent channels backward during stacking of the bleachers and forward during the extension of the bleachers.

DETAILED DESCRIPTION OF THE INVENTION

Figure 1:
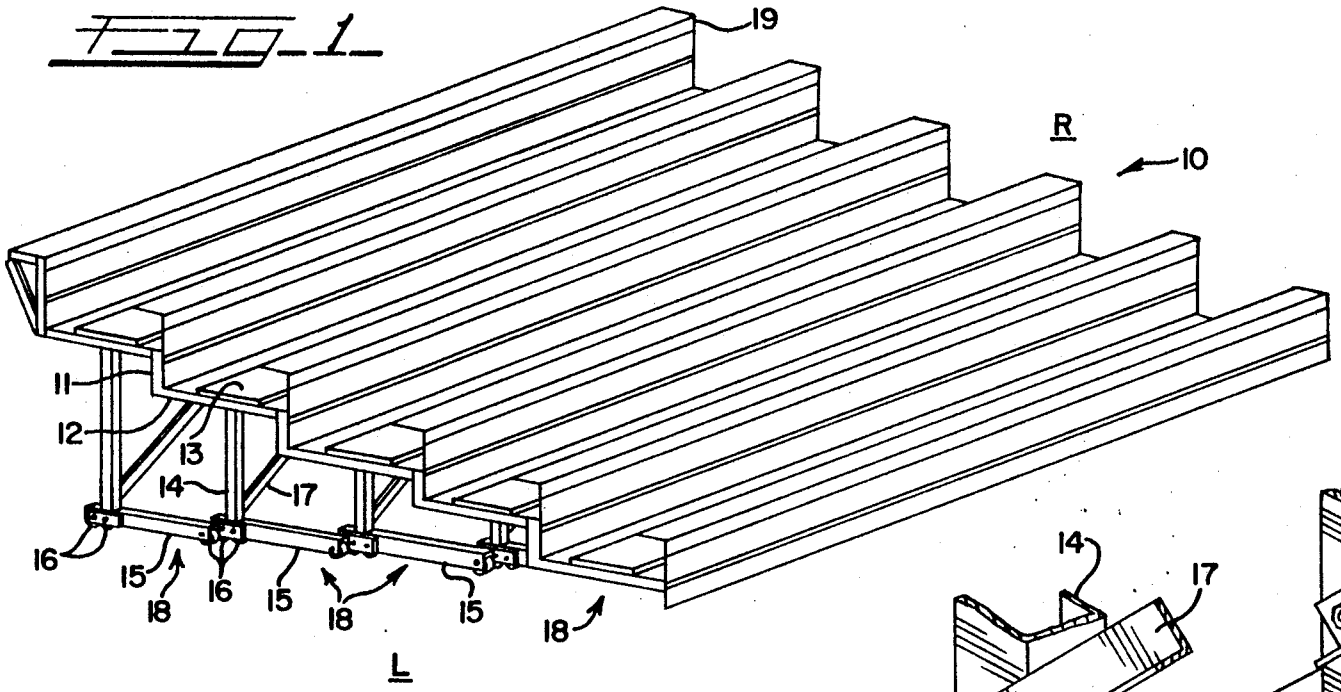
FIG. 1 is a perspective view of manually or power operated telescoping gymnasium bleachers with the wheel channel guide lock invention incorporated therein.

The invention is primarily directed toward the prevention of the collapse of gymnasium bleachers of the manual telescoping type illustrated by bleacher system 10 of FIG. 1. It will be understood that the invention is useful for retrofitting existing bleachers and also in the original manufacture of a bleacher system.

Figure 5:
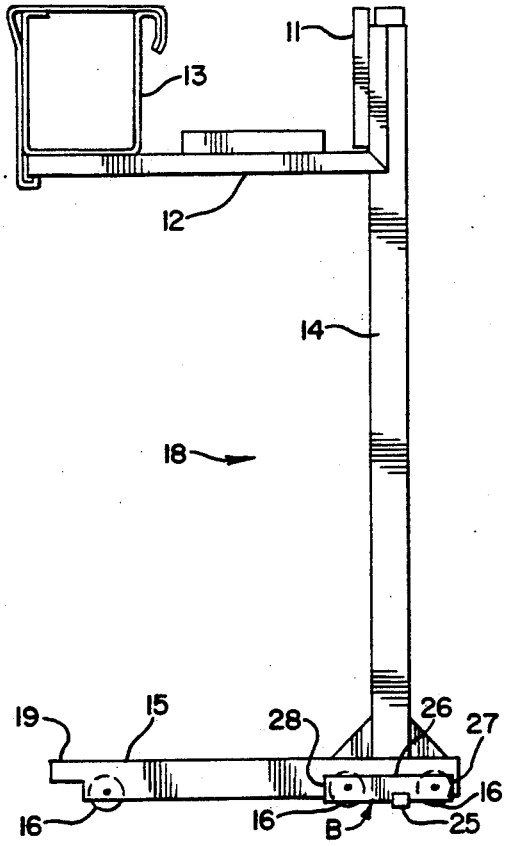
FIG. 5 is an interior elevational view of one of the intermediate bleacher rows at the left hand side showing the seat assembly support post and wheel channel therefor, and the engagement of a bracket of the type slidable along a slide rod; and, FIG. 6 is a partial elevational view of the opposite, or exterior side, of the support post and channel as in FIG. 5, showing the attachment of two of the other type brackets therealong for attachment to a slide rod at either end.

With reference to FIGS. 1 and 5, in the bleacher system 10 a plurality of telescoping row units are linked together and each includes a skirt board 11, foot board 12, and seat assembly 13, which are mounted on a vertical support 14 that is supportably carried on channels 15 having a plurality of wheels 16. Cross bracing 17 is provided for structural support of each individual row unit, generally denoted at 18, formed by the members 11–17 as described. An uppermost seating portion 19 is independently attached to a wall, building structure, or the like, in a known way and supported above the rearmost unit 18, as would be understood by those skilled in the particular art. The vertical supports 14 and cross bracing 17 are progressively shorter moving from the rear to the front of the bleacher system and are nestable against each other in a known way. The frontmost unit 18 will have a sufficiently sized vertical support 14 whereby the spectator may sit on the frontmost seat with his or her feet resting upon the gymnasium floor.

Typically, gussets, connection welds, row locks, and finger detents, are originally provided for rigidifying the system and for interlocking the wheel channels 15 to prevent inadvertent collapse. These, bleacher elements can deteriorate through improper maintenance to create unsafe conditions. They are not illustrated in detail in the drawings inasmuch as the present invention may be originally installed or retrofitted onto existing systems substantially independently of these known prior art structural and safety devices.

Figure 2:
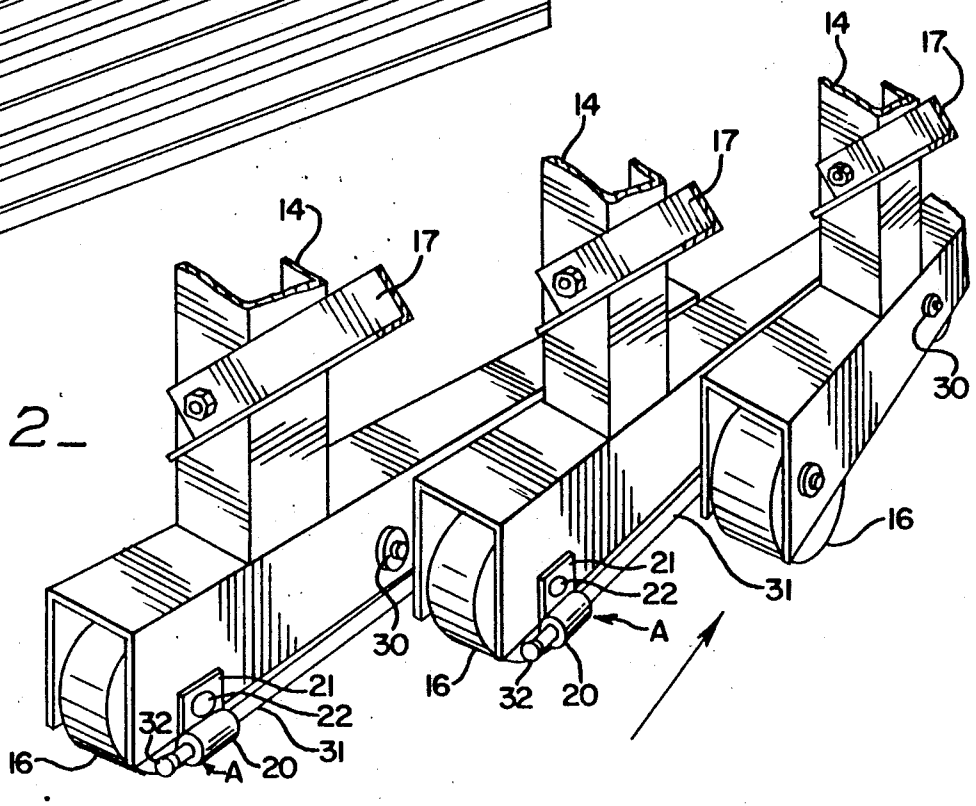
FIG. 2 is a perspective view of three sequential wheel channels of the bleachers in FIG. 1, including partially broken away structural supports for the bleacher rows, and illustrating the engagement of the wheel channel guide-lock assembly of the invention.

Turning now to FIG. 2, a perspective view of the interior of the righthand side R of the bleacher system 10 of FIG. 1 shown looking frontward underneath the bleacher seats. The arrow in FIG. 2 is therefore pointed toward the lowermost seats in the bleacher system 10. The wheel channels 15 are in the fully extended position for accommodating spectators on the bleacher seats. This arrangement will be further made clear with respect to the horizontal plan view of FIG. 3 showing lefthand L and righthand R wheel channels of the bleacher system 10 including the wheel channel guide-lock assembly.

In the exemplary embodiment, two wheels 16 are located generally under the support columns 14 and one wheel 16 is located at the forward ends 19 of the wheel channels. The invention provides two types of brackets denoted A or B, which each have formed therewith one axle for retrofit engagement with existing wheels 16 as replacements for the old axles. The brackets A and B are easily secured to the channels 15 by mechanical push, or snap, on fasteners attached to the ends of their replacement axles.

A wheel channel 15 of FIG. 2, located at the upper right thereof, does not have an A bracket because it is the frontmost channel and is only connected at its rear end to the next channel at the opposite hidden side of the channel. FIG. 3 shows both left and right frontmost channels 15 in greater detail.

Figure 3:
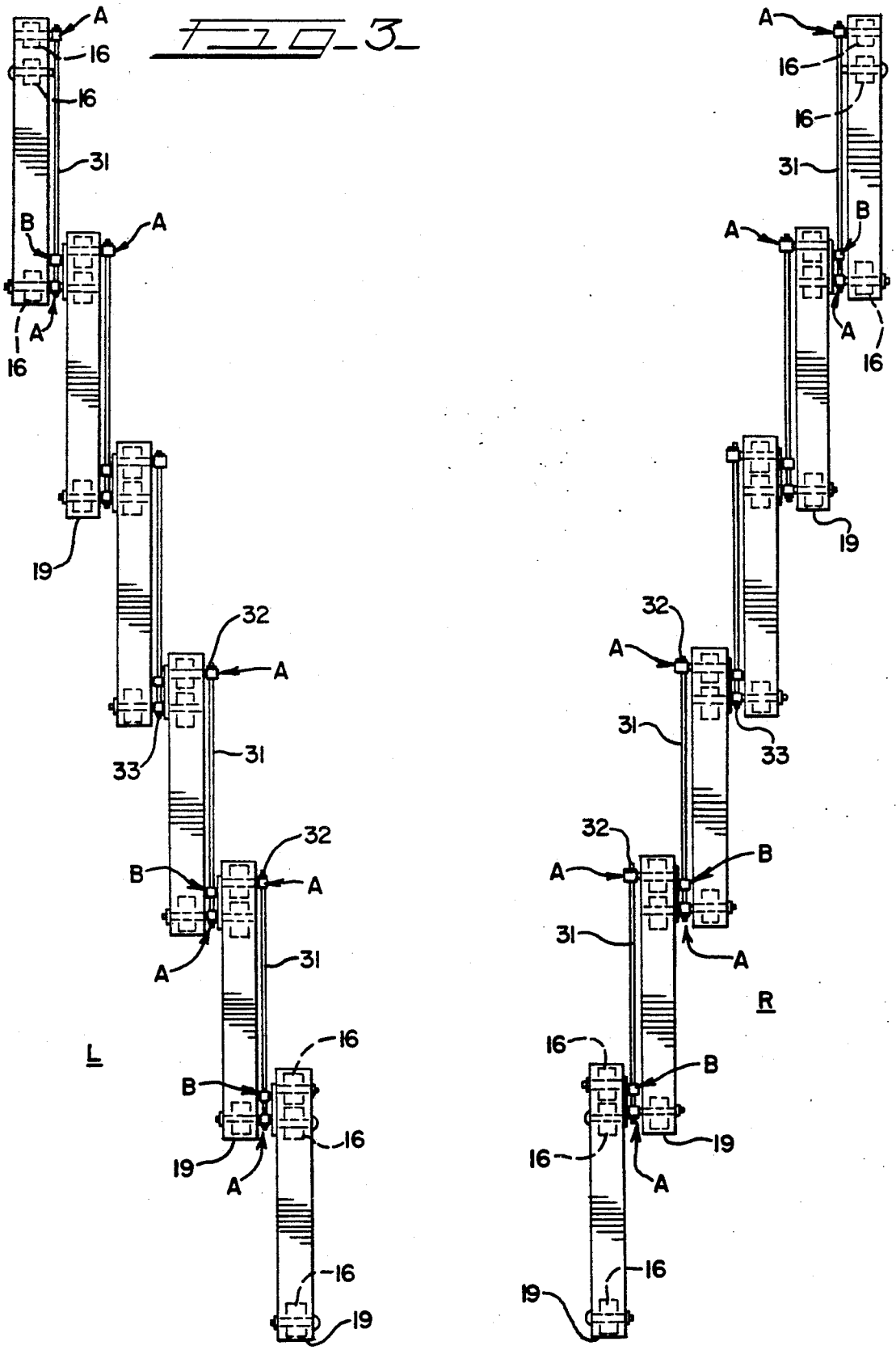
FIG. 3 is a horizontal plan view of the wheel channels for the bleachers looking on plane 3—3 of FIG. 1 in the direction of the arrows showing both the left and right hand sets of wheel channels in the extended position and having the wheel channel guide lock assembly installed on the wheel channels.
Figure 4:
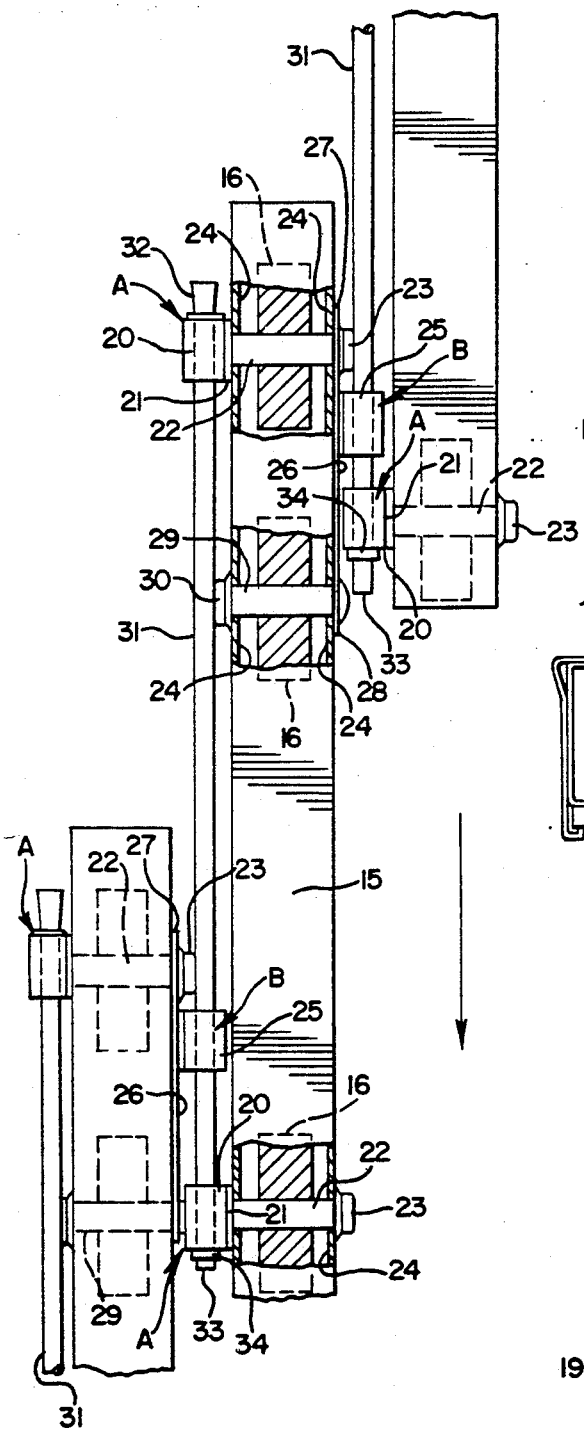
FIG. 4 is a plan partially broken-away view of the connection between intermediate sequential wheel channels of the bleacher in FIG. 1, showing the engagement of replacement axles of the brackets of the wheel channel guide lock assembly of the invention and slide rods guiding the motion of one type of bracket therealong.
Figure 6:
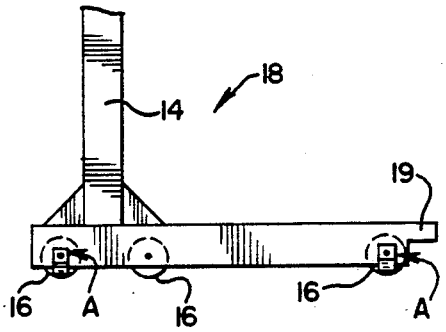

The details of the brackets A and B are more particularly described with joint reference to FIGS. 2 and 4, and the sequential arrangement in FIG. 3. The brackets A are comprised of a cylindrical sleeve 20 jointed to a flange 21 having projecting therefrom a replacement axle 22 for extending through a wheel channel 15 to be secured at the other side by a, mechanical friction fastener, or snap on cap, or the like, such as the push nut 23 in the disclosed embodiment. In the exemplary form of the invention, the attachments of the rear brackets A to the wheel channels 15 are at the rearmost wheel locations generally behind the vertical support column 14 as shown in FIG. 2. Except for the frontmost unit 18, the channels 15 are mounted with a second bracket A, at the wheel location at the front end 19, as shown in FIG. 4. Further with regard to FIG. 4, it will be seen that the wheels 16 are held between parallel bearing plates 24 at opposite interior sides of the wheel channels 15 which bearing plates and wheel channels have coaxial apertures for rotationally supporting the axles. The plates 24 rotationally support the wheels 16 and allow for the wheels to extend below the channels 15 to enable rolling the units 18.

At the sides of the wheel channels 15 opposite the attachment of the rear brackets A, the brackets B are attached in conformance with the invention and best shown in FIG. 4. In the exemplary embodiment, the brackets B provide for the replacement of the axle of the other rear wheel 16. Each bracket B has a sleeve 25. The brackets B further include elongate flange portions 26 joined to the sleeves 25, being longer than flanges 21 and which have ends 27 extending past the rear push nuts 23 of the brackets A thereat. The bracket flange portions 26 provide apertures therethrough for accommodating the replacement axles 22 extending from the flanges 21 of the brackets A at the other side of the wheel channel 15. The elongate flange portions 26 extend in the forward direction to terminate at ends 28 past a next rear wheel 16. Each flange portion 26 is also formed with a replacement axle, denoted at 29, for extension through the wheel channel 15 in replacement of this next wheel axle located forward of the rear wheel that is engaged by an A bracket. Similarly push nuts 30, or equivalent fastener, secure the axles 29 at the opposite, or interior, sides of the wheel channels 15. The replacement axles 29 accordingly also extend through existing apertures in the sides of the wheel channels 15 and through the associated wheel bearing plates 24.

Joining sequential wheel channels 15 together are slide rods 31 provided in lengths sufficient to extend through both of the brackets A at one side of a wheel channel, as shown in FIG. 4. The slide rods 31 include flattened ends 32 and at the opposite ends 33 they are capped by push nuts 34, or equivalent, for preventing the displacement of the slide rods 31 outwardly of the brackets A at either ends thereof. The diameters of the slide rods 31 are sized to be slidably accommodated within the sleeves of the brackets A and B. It will be noted that for sequential wheel channels 15, the sleeves 25 of the brackets B slidingly reside on slide rods 31 between the brackets A of the next sequential -and bleacher outwardly - wheel channels 15. The slide rods 31 are thereby substantially concealed when looking from the side of the bleacher system 10, because they reside on interior sides of the wheel channels. Accordingly, best viewed in FIGS. 2 and 4, when the row units 18 are restacked, the wheel channels 15 will be pushed in a direction opposite the arrows, whereby, for example in FIG. 4, the bracket B mounted on the lefthand channel 15 slides toward the rear bracket A of the next wheel channel 15 stops upon contacting it.

The arrangement of the brackets A and B, and slide rod 31, is the same on sequential channels 15, except for the first and last wheel channels. Specifically, with reference to FIG. 3, looking at the first channels 15 of both the left and righthand sides, there is provided only a bracket B at the rear ends thereof. The front end 19 and wheel 16 thereat extend to reside generally under the seat of the first unit 18.

At the rear end of the bleacher system 10, the last left and right wheel channels 15 include two A brackets at the same side thereof, but do not include brackets B at the other side.

The brackets B for the left and right sides of the bleacher system 10 are not identical but instead are mirror images in order to be either righthanded or lefthanded for attachment at the mirror image channel locations, as will be understood.

In the preferred embodiment, the brackets A and B, are manually engageable without needing special tools to the sides of the wheel channels 15 by means of the push nuts 23 and 30, respectively. The replacement axles 22 and 29 preferably are weld-engaged to the plates 21 and 26, respectively.

In one form of the invention, when used as a retrofit, the axles of the brackets A and B are engaged to existing bleacher wheels. However, new replacement wheels may also be provided in the event that deteriorated wheels in situ are encountered and should be replaced.

In an alternate form of the invention, the brackets B may constructed to have the replacement axle 29 at the other end of flange 26 to be usable at the rearmost wheel of a channel. In this way the bracket A would be moved to a wheel other then the rear one. As a result, the positioning of the sleeve 25 along the flange 26 of a bracket B may be formed at different locations therealong. In the disclosed embodiment, the rear ends of the wheel channels 15 will stack to reside substantially in the same plane along a gymnasium wall, or the like, when the brackets B move sequentially rearwardly to contact the brackets A of the next outward adjoining wheel channels 15 in a telescoping fashion. The spacing of the sleeve 25 along the flange 26 thus takes into account the distance between the rear axle of the channels and the channel ends in the preferred embodiment. Alternate locations for the sleeves 25 on the brackets B may be made to accommodate different channel and axle configurations as one skilled in the art will appreciate.

Another alternate embodiment of the invention will provide for the bracket B to have a flange substantially the same as that of the A bracket and not span two axles, but rather engage only at one wheel location with a replacement axle formed therewith. For example, at the rear end of the middle wheel channel 15 shown in FIG. 4, the bracket B would have its sleeve 25 spaced to be axially aligned with its replacement axle 29 and the remaining portion of the flange 26 extending toward the channel rear end would be eliminated. In this way, the bracket B would be substantially identical to the bracket A whereby a wheel channel 15 would have the two brackets A at one side and a similarly formed bracket B at the other side slidingly engageable along a slide rod between brackets A of the next outwardly sequential wheel channel 15.

In yet another embodiment, the bleacher system 10 may be provided with wheel channels having a plurality of wheels 16 also at the front end 19. The engagement by a bracket A then could be at any of the front axle locations for axle replacement instead of limited to the single wheel location at end 19 of the wheel channels 15 disclosed.

Other modifications and equivalents fall within the broad scope of the invention and claims appended hereto. Accordingly, the foregoing is disclosed for the purposes of explanation and is not considered as limiting the claim coverage to the particular embodiment specified.

I claim:

1. A wheel channel guide-lock assembly for telescoping bleacher systems of the type having wheel channels and wheels mounted therein for movably supporting rows of seats and support structure therefor, and wherein each row and wheel channels therefor are telescopingly stackable to be sequentially slidable past one another, comprising between two adjacent wheel channels of sequentially supported bleacher rows, a pair of bracket means mounted at one side of one channel, and at an opposing side of the adjacent wheel channel, a second type bracket means attached thereto, said both type bracket means including axle means extending therefrom and rotationally engaging wheels of the wheel channels, sleeve means extending from said both type bracket means between said wheel channels, the sleeve means of the second type bracket means spaced between said pair of bracket means, a slide rod extending between the sleeve means of the pair of said bracket means and through said sleeve means of the second type bracket means, whereby said second type bracket means and associated wheel channel means are slidable along the slide rod with said second type bracket means being slidable between said pair of bracket means to be stopped thereagainst and thereby provide a lock for said wheel channels.

2. The wheel channel guide-lock assembly as claimed in claim 1 wherein said axle means of the bracket means extend through said wheel channels to terminate at axle ends at the opposite side of the wheel channels.

3. Said wheel channel guide-lock assembly as claimed in claim 2 wherein said bracket means are engaged to said wheel channels by mechanical fastener means secured at the axle ends.

4. The wheel channel guide-lock assembly as claimed in claim 1 wherein said second type bracket means includes an elongate flange portion having said axle means extending therefrom and at a spaced location from the axle means an aperture therethrough receiving therein the axle means of one of another pair of the first type bracket means having the sleeve means thereof at the opposite side of the wheel channel.

5. The wheel channel guide-lock assembly as claimed in claim 4 wherein the axle means of the first type bracket means received in the aperture of said second type bracket means has mechanical fastener means secured thereto outwardly of said aperture.

6. A guide-lock assembly for wheel channels of telescoping bleacher systems, said assembly comprising:

at least one wheel channel having a pair of first type brackets attached at a side thereof, said first type brackets having sleeve means for accommodating therethrough a slide rod;

a slide rod means for extending between said two first type brackets and through said sleeve means thereof;

said pair of first type brackets each further including axle means extending therefrom and rotationally engaging wheels of said one wheel channel;

a second type bracket having sleeve means slidably accommodating said slide rod means therein and axle means extending therefrom rotationally engaging a wheel of a second wheel channel adjacent said one wheel channel; and, said sleeve means of the second type bracket slidingly located on said slide rod means between the sleeve means of the pair of first type brackets.

7. The guide-lock assembly as claimed in cliam 6 wherein the first type brackets being attached to the one wheel channel to locate said sleeve means at the interior side of said one wheel channel and said second type bracket being engaged to dispose the sleeve means thereof at the exterior side of said adjacent second wheel channel, whereby said slide rod means is substantially hidden from view from the outward side of the wheel channels of a bleacher system.

8. The guide-lock assembly as claimed in claim 6 wherein said axle means of the first type brackets extend through apertures of said one wheel channel and means for mechanically securing ends thereof outwardly of the one wheel channel.

9. The guide-lock assembly as claimed in claim 6 wherein said pair of first type brackets form end stops for the sliding motion of said second type bracket therebetween along said slide rod means, whereby wheel channel dislocation is prevented.

10. The guide-lock assembly as claimed in claim 6 further comprising:

two mirror image opposing sets of sequentially adjacent telescoping wheel channels at left and right hand sides of a bleacher system and extending from a first row of bleachers to a last row of bleachers wherein each bleacher row is movable on its opposing left and right wheel channels.

11. The guide-lock assembly as claimed in claim 10 wherein the adjacent wheel channels between the first and last row sets of wheel channels each have a pair of said first type brackets and slide rod means at one side thereof and a second type bracket at the opposite side thereof slidably engaging a slide rod means at an adjacent wheel channel.

12. The guide-lock assembly as claimed in claim 6 wherein said brackets include flange means disposed against said wheel channels.

13. The guide-lock assembly as claimed in claim 12 wherein said second type bracket flange means is greater in length than the first type bracket flange means and sufficient to extend from said axle means thereof to a next closest wheel of said one wheel channel.

14. The guide-lock assembly as claimed in claim 13 wherein said flange means of said second type bracket further includes an aperture means receiving an axle therethrough of said next closest wheel.

* * * * *